US011072936B2

(12) United States Patent
Georgoff et al.

(10) Patent No.: US 11,072,936 B2
(45) Date of Patent: Jul. 27, 2021

(54) BABY AND KIDDIE POOL SUNLESS WATER HEATER WITH CIRCULATING PUMP

(71) Applicants: Patrick Georgoff, Ann Arbor, MI (US); Lisa Georgoff, Ann Arbor, MI (US)

(72) Inventors: Patrick Georgoff, Ann Arbor, MI (US); Lisa Georgoff, Ann Arbor, MI (US)

( * ) Notice: Subject to any disclaimer, the term of this patent is extended or adjusted under 35 U.S.C. 154(b) by 0 days.

(21) Appl. No.: 16/515,468

(22) Filed: Jul. 18, 2019

(65) Prior Publication Data

US 2020/0024860 A1 Jan. 23, 2020

Related U.S. Application Data

(60) Provisional application No. 62/699,916, filed on Jul. 18, 2018.

(51) Int. Cl.
*E04H 4/12* (2006.01)

(52) U.S. Cl.
CPC ..... *E04H 4/129* (2013.01)

(58) Field of Classification Search
CPC ..... A47K 3/022; A61G 7/0005; A61H 2201/0221; A61H 33/0087; E04H 4/1209; E04H 4/129; E03D 9/08; F24H 1/0081
USPC ..... 4/493
See application file for complete search history.

(56) References Cited

U.S. PATENT DOCUMENTS 4,222,366 A 9/1980 Acker
4,366,806 A 1/1983 Acker
4,470,404 A 9/1984 Kremen
5,143,052 A 9/1992 Case
5,347,984 A 9/1994 Klaren
5,408,707 A * 4/1995 Wilson ..... A61H 33/0087 220/592.25
5,431,148 A 7/1995 Kronberg
5,524,820 A * 6/1996 Regan ..... F24H 1/06 122/13.3
5,809,942 A 9/1998 Kralovec et al.
6,105,178 A * 8/2000 Kurisaki ..... E03D 9/08 4/420.4
6,327,718 B1 * 12/2001 Ono ..... E03D 9/08 4/420.2
6,357,059 B1 * 3/2002 Lau ..... A61H 33/0087 4/506
6,508,247 B1 1/2003 Karales
7,093,593 B2 8/2006 Rosene et al.
(Continued)

*Primary Examiner* — David P Angwin
*Assistant Examiner* — Nicholas A Ros
(74) *Attorney, Agent, or Firm* — Juan Carlos A. Marquez; Marquez IP Law Office, PLLC

(57) ABSTRACT

A portable device designed specifically to heat the water in a kiddie pool includes multiple safety features for use among children and pets. This device will allow for comfortable play in the kiddie pool during all hours of the day, even in the absence of sunlight. This device will allow for pools to be set up in the shade and still heated to a comfortable temperature. A standard 120-volt power outlet powers the device. Primary components include a double insulated reservoir, a self-priming pump, heating element, inflow and outflow hoses, and multiple safety features. It is lightweight, portable and specifically designed for use in kiddie pools.

5 Claims, 5 Drawing Sheets

(56) References Cited

U.S. PATENT DOCUMENTS

| | | | | |
|---|---|---|---|---|
| 7,461,416 | B2 * | 12/2008 | Stover | E04H 4/129 4/493 |
| 8,569,663 | B2 | 10/2013 | Qin et al. | |
| 9,200,465 | B2 | 12/2015 | Mireshghi | |
| 2003/0149410 | A1 | 8/2003 | Kudo et al. | |
| 2009/0204263 | A1 | 8/2009 | Love | |
| 2011/0094025 | A1 * | 4/2011 | West | E04H 4/129 4/506 |
| 2013/0145538 | A1 | 6/2013 | Seccareccia | |
| 2014/0140862 | A1 * | 5/2014 | Elbaz | E04H 4/1209 417/61 |
| 2015/0260428 | A1 * | 9/2015 | Haldeman | E04H 4/129 4/493 |
| 2017/0227256 | A1 | 8/2017 | Wu | |

* cited by examiner

BABY AND KIDDIE POOL SUNLESS WATER HEATER WITH CIRCULATING PUMP

CROSS-REFERENCE TO RELATED APPLICATIONS

This application claims priority to U.S. Provisional Patent Application No. 62/699,916 filed Jul. 18, 2018, which is hereby incorporated by reference.

PRIOR ART REVIEWED

A patent search was conducted and revealed the following prior patents and published applications. We have concluded that there do not appear to be any prior inventions that incorporate all the features of the embodiments of our invention.

U.S. Pat. No. 9,200,465
U.S. Pat. No. 8,569,663
U.S. Pat. No. 7,093,593
U.S. Pat. No. 6,508,247
U.S. Pat. No. 5,809,942
U.S. Pat. No. 5,431,148
U.S. Pat. No. 5,347,984
U.S. Pat. No. 5,143,052
U.S. Pat. No. 4,470,404
U.S. Pat. No. 4,366,806
U.S. Pat. No. 4,222,366
U.S. Publication No. 2017/0227256
U.S. Publication No. 2015/0260428
U.S. Publication No. 2013/0145538
U.S. Publication No. 2009/0204263
U.S. Publication No. 2003/0149410

Additionally, Underwriters Laboratory (Northbrook, Ill.) has confirmed that they have never received an idea or invention submission that aims to heat the water in a kiddie pool and that our invention meets their "New and Innovative" category. Therefore, we have concluded to the best of our knowledge that this is an entirely original idea and we are not infringing on any existing patents or products on the market. Finally, an exhaustive internet marketplace search was performed that yielded no similar inventions.

FIELD OF INVENTION

Certain embodiments of the present invention include, but are not limited to, heating a small body of water, specifically intended for a baby or kiddie pool to a comfortable temperature using a circulating pump with a heater. For the purpose of this application, a baby or kiddie pool is defined as a small, portable, above ground pool typically used for wading and water play that contains less than 500 gallons of water, but more commonly between 10 and 60 gallons of water.

BACKGROUND OF THE INVENTION

Currently, when families prepare a kiddie pool for their children, they typically just use water from a standard outdoor faucet. However, the water that comes out of those standard outdoor faucets is cold. Babies and children—who are usually excited to play in the water—are turned away because of the cold temperature. What would normally be fun filled outdoor activity is cut short by chattering teeth and goose bumps. There are currently no products on the market that heat a kiddie pool. Some strategies used to warm a kiddie pool include setting the pool up in the sun, adding boiled water and using an indoor sink attachment for a garden hose. These options are ineffective.

Relying on the sun to heat the water limits the use of a kiddie pool to warm, sunny days and requires the pool to sit in the sun for long periods of time. Once full, a kiddie pool is too heavy to move to a shaded location. Playing in the direct sunlight exposes children to harmful ultraviolet radiation. Solar discs, which are currently marketed for larger pools but could potentially be used in a kiddie pool, also require sunlight and long periods of time. Manually adding pots of boiling water to the kiddie pool is dangerous and ineffective. Based on our own testing, it takes 3 hours and 7 gallons of boiled water to heat 20 gallons of water just 21 degrees. Walking back and forth between the house and a kiddie pool with boiling water is cumbersome, dangerous, and ineffective. The last option is purchasing an indoor sink attachment for a garden hose. The user would need to empty and refill the pool each time they want warm water in the kiddie pool. Additionally, this option requires bringing a potentially dirt filled hose inside your home to lay on the floor or through a window.

Cold water in kiddie pools is a problem for parents and caregivers everywhere. The internet is filled with blog sites where parents and caregivers are complaining about this problem and searching for a solution to safely and quickly warm their kiddie pools. Market research conducted throughout the Unites States has confirmed that 69% of kiddie pool owners say their kiddie pools are either always or sometimes too cold for their child to comfortably play in and 77% of kiddie pool owners are interested in a product that can warm the water in their kiddie pools. Additionally, 58% of dog owners throughout the United States are interested in a product that could warm a kiddie pool and allow them to bathe their dogs outside.

SUMMARY OF THE INVENTION

The present invention is a portable device that is designed specifically to heat the water in a kiddie pool. It includes multiple safety features for use among children and pets. This device will allow for comfortable play in the kiddie pool during all hours of the day, even in the absence of sunlight. This device will allow for pools to be set up in the shade and still heated to a comfortable temperature. Parents and caregivers will now be able to use their kiddie pool any day the temperature is warm enough to be in a bathing suit. This device could also be used for heating bath water in austere environments like campsites, and for use in bathing pets outdoors in a kiddie pool.

The present invention is a first of its kind product that seeks to provide a solution to this problem by providing a safe, affordable, fast, and easy to use device to increase the water temperature in a kiddie pool. A standard 120-volt power outlet powers the present invention. Primary components include a double insulated reservoir, a self-priming pump, heating element, inflow and outflow hoses, and multiple safety features. It is lightweight, portable and specifically designed for use in kiddie pools.

BRIEF DESCRIPTION OF THE DRAWINGS

The present invention as disclosed and claimed hereinabove is illustrated in FIGS. 1-5, wherein:

DETAILED DESCRIPTION OF THE INVENTION

Figure 1:
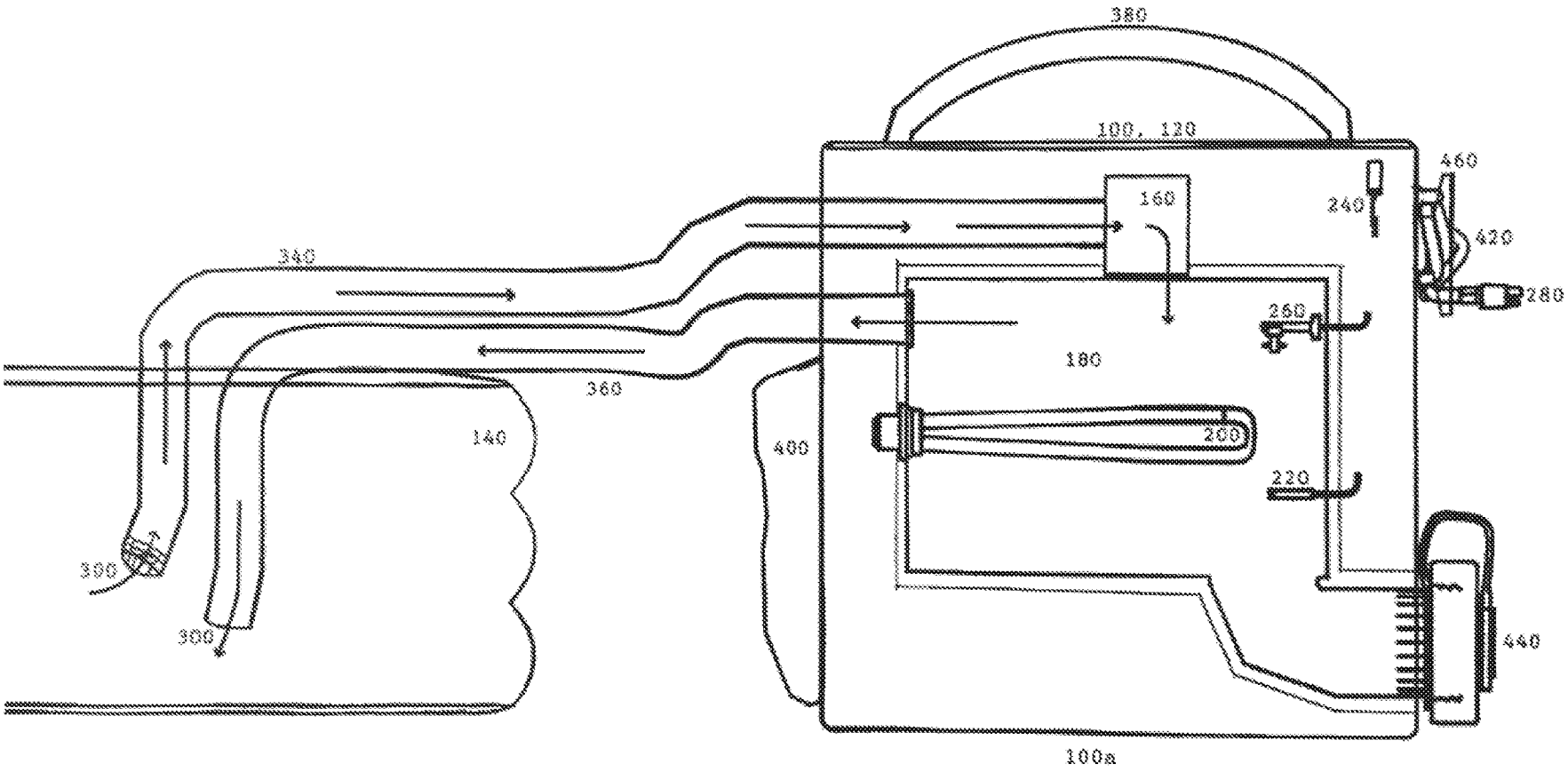
FIG. 1 depicts all of the individual components of the present invention.
Figure 2:
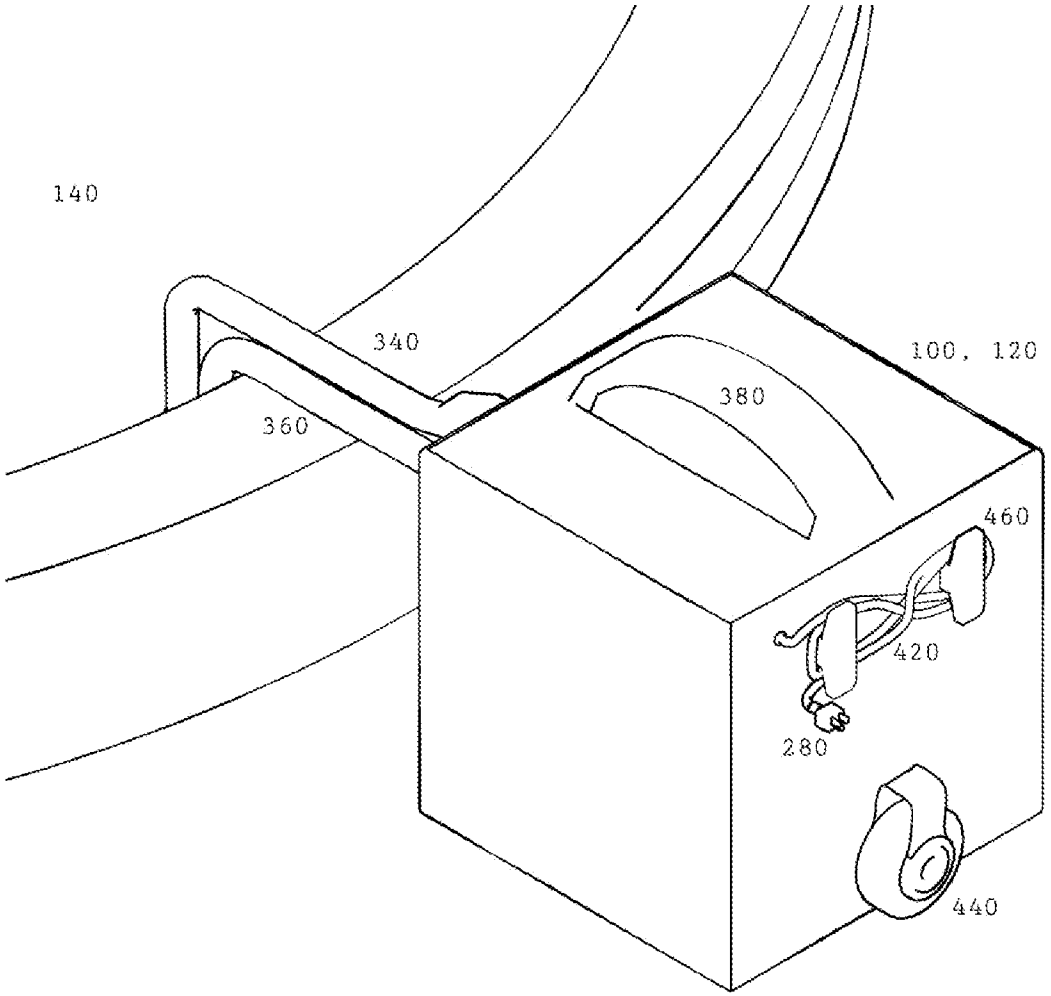
FIG. 2 depicts the outer box of the present invention, the drain, cord storage and both the inflow and outflow hoses placed into a kiddie pool of the present invention.

The present invention is a portable kiddie pool heater 100 designed for everyday use. (FIG. 1 and FIG. 2) Inside an outer casing 100*a*, a heater 120 plugs into a standard 120-volt power outlet and is used to heat an already filled kiddie pool 140. The present invention uses a self-priming pump 160. The self-priming pump 160 uses a diaphragm design to move air or water. The pump will run on 6 to 12-volt direct current with a flow of 2 to 10 liters per minute and a vertical suction lift of at least 5 feet. The pump will be used to draw water from the kiddie pool 140 via the flexible vinyl inflow hose 340. The inflow hose will fill an inner reservoir 180. Electrical components are mounted on the outside of the inner reservoir 180, which is covered by an outer protective casing. Insulation between the inner reservoir 180 and outer casing 100*a* is achieved with air. Once inside, the water is warmed with an Underwriters Laboratory-approved 1500-watt, 120-volt, high-density water heating element 200. As the reservoir 180 continues to fill, warm water is returned to the pool 140 via the flexible vinyl outflow hose 360.

Figure 3:
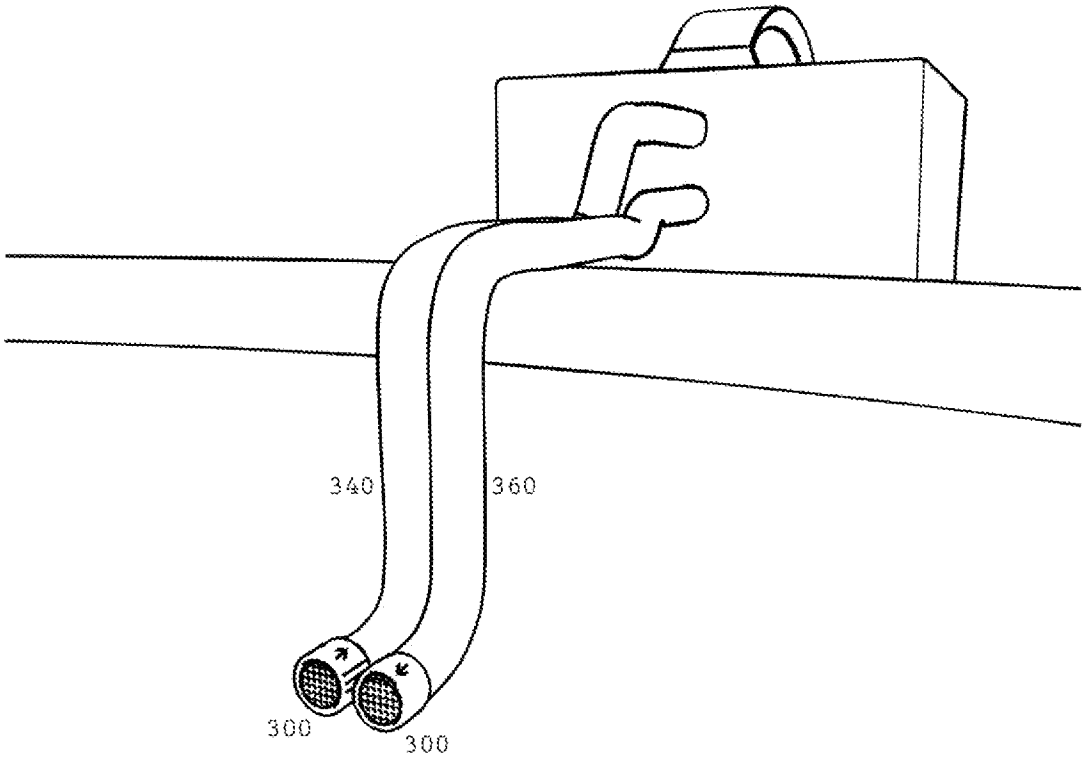
FIG. 3 depicts both the inflow and outflow hoses placed in the pool and the safety screens on the ends of both of the hoses of the present invention.

The portable kiddie pool heater 100 includes multiple safety features including (see FIG. 1): a thermostat control switch 220 consisting of a waterproof negative temperature coefficient thermistor that automatically turns off the unit once a predetermined maximum temperature is reached; a metallic ball design tilt angle sensor 240 that will immediately turn off the unit if it is tipped over; and a water level float switch similar to those used in fish tanks 260 that allows power to the heating element only when it is fully submerged in water; a double-insulated design that separates water from electrical components and electrical components from product users (see FIG. 1); a waterproof extension cord gasket 280 specially designed to protect from short-circuiting; and screens 300 at the end of both inflow and outflow hoses 340,360 for safety purposes and to prevent debris from entering the reservoir 180. (FIG. 3)

Figure 4:
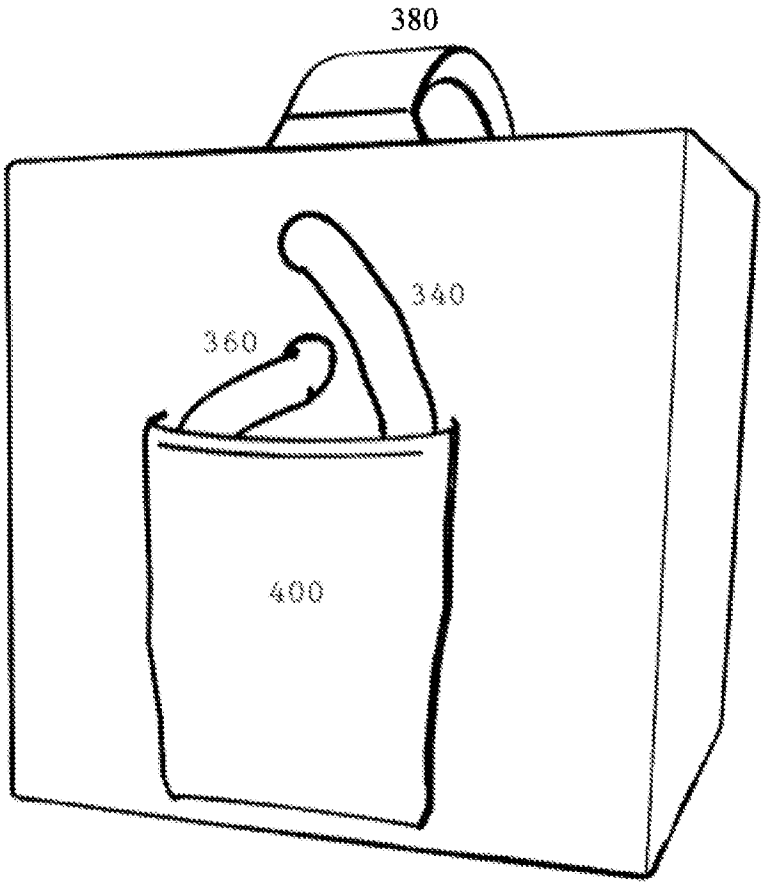
FIG. 4 depicts the mesh bag for convenient hose storage that provides air flow for drying purposes of the present invention.
Figure 5:
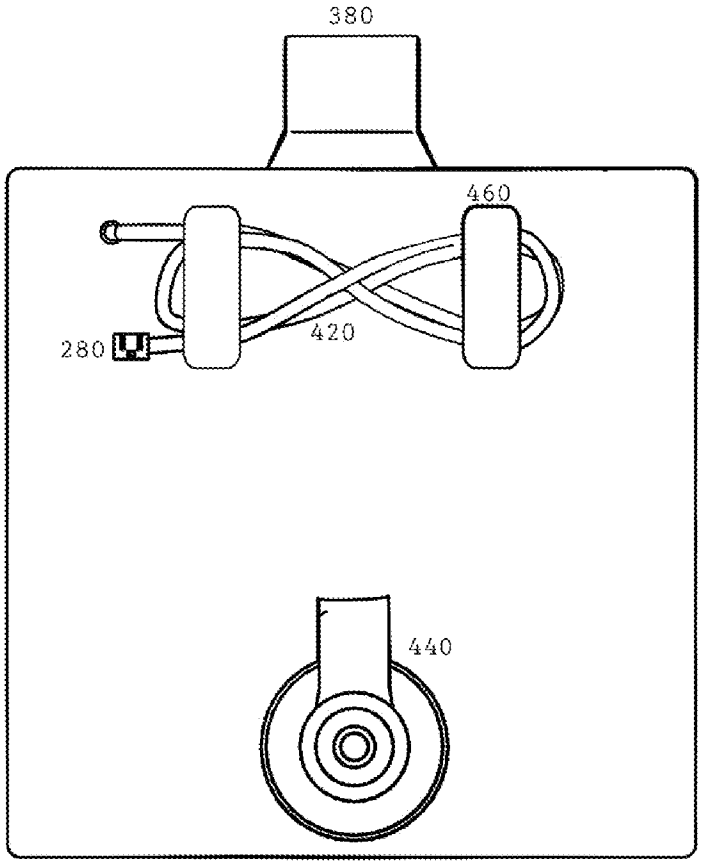
FIG. 5 depicts easy cord storage as well as the drain of the present invention.

Additional features include a carrying handle 380, a mesh bag 400 to store the inflow and outflow hoses 340,360 (FIG. 4) and attached hooks 460 to wrap and secure the electrical cord 420. (FIG. 5). The portable kiddie pool heater 100 also features a large drain 440 to allow the egress of water once heating is finished. When stored, the large drain 440 can be left open to allow the reservoir 180 to dry and to prevent the buildup of mold and other contaminants (see FIG. 5).

Although the present invention has been fully described in connection with the preferred embodiment thereof with reference to the accompanying drawings, it is to be noted that various changes and modifications will be apparent to those skilled in the art. For example, the portable kiddie pool heater according to the present invention may include additional safety features to improve use or safety among children, and to improve use among pets. The portable kiddie pool heater 100 may include additional temperature sensors on more or different parts of the unit intended to measure water temperature or the temperature of the device itself, such as a temperature sensor on the outbound hose. Additionally, the portable kiddie pool heater 100 may include use of more than one heating coil, or use of a different style, shape or intensity heating coil. The portable kiddie pool heater 100 may also include a different heating element in addition to or besides a coil. The pump device of the portable kiddie pool heater 100 may be modified to use a different style pump, including a pump that is not self-priming; or a pump that is located in a different spot. The portable kiddie pool heater 100 may be changed so that it needs to be powered with greater than 120 V. The inflow and outflow hoses may be combined into a single unit. The lengths of the inflow and outflow hoses may be modified to increase the distance of the device from the kiddie pool. The portable kiddie pool heater 100 may also be altered so that it can be powered by a battery. Such changes and modifications are to be understood as included within the scope of the present invention as defined by the appended claims, unless they depart therefrom.

The invention claimed is:

1. A device for warming a kiddie pool, consisting of:

an outer casing;

an insulated watertight reservoir inside the outer casing and in which water to be pumped to the kiddie pool is warmed, the watertight reservoir including a heating element for warming the water therein, the watertight reservoir being separate from the kiddie pool;

an input hose through which water from a pool is pumped into the watertight reservoir to be warmed by the heating element, the input hose including an input filter screen mounted on an input end of the input hose;

an output hose through which the water from the watertight reservoir after being warmed flows back to the pool; and a self-priming pump operatively connected to the input hose to pump the water to be warmed into a top-side portion of the watertight reservoir, wherein the heating element includes a shutoff sensor operatively connected to turn off the heating element when the watertight reservoir is tipped over from an upright operating position, a thermostat control switch operatively connected to turn off the heating element when a predetermined maximum temperature in the watertight reservoir is reached, and a float sensor operatively connected to the watertight reservoir to controllably prevent activation of the heating element when the float sensor is not fully submerged in water in the watertight reservoir.

2. A device according to claim 1, wherein the pump is connected between the input hose and the watertight reservoir to pump the water into the watertight reservoir.

3. A device according to claim 1, wherein the pump is fixedly connected to the watertight reservoir to pump the water from the input hose into the watertight reservoir.

4. A device according to claim 1, wherein the pump is configured with a safety filter on an input side of the pump.

5. A device according to claim 1, wherein the watertight reservoir is configured to be resistant to tipping over.

* * * * *